US010730340B2

(12) United States Patent
McGrory

(10) Patent No.: US 10,730,340 B2
(45) Date of Patent: Aug. 4, 2020

(54) MOUNTABLE BUCKET SYSTEM

(71) Applicant: Keith McGrory, Waterford (IE)

(72) Inventor: Keith McGrory, Waterford (IE)

(73) Assignee: HIGHTOWER PAINTING PRODUCTS LIMITED, Waterford (IE)

( * ) Notice: Subject to any disclaimer, the term of this patent is extended or adjusted under 35 U.S.C. 154(b) by 0 days.

(21) Appl. No.: 15/779,125

(22) PCT Filed: Nov. 28, 2016

(86) PCT No.: PCT/EP2016/079050
§ 371 (c)(1),
(2) Date: May 25, 2018

(87) PCT Pub. No.: WO2017/089619
PCT Pub. Date: Jun. 1, 2017

(65) Prior Publication Data

US 2018/0345716 A1 Dec. 6, 2018

(30) Foreign Application Priority Data

Nov. 27, 2015 (GB) ..... 1520974.5

(51) Int. Cl.
*B44D 3/12* (2006.01)
*B44D 3/14* (2006.01)
*B65D 25/22* (2006.01)

(52) U.S. Cl.
CPC ..... *B44D 3/123* (2013.01); *B44D 3/125* (2013.01); *B44D 3/14* (2013.01); *B65D 25/22* (2013.01)

(58) Field of Classification Search
CPC .. B25H 3/00; A46B 17/02; B44D 3/12; B44D 3/123; B44D 3/125; B44D 3/14;
(Continued)

(56) References Cited

U.S. PATENT DOCUMENTS 6,047,648 A * 4/2000 Alm ..... A47B 13/021 108/157.16
7,293,748 B1 * 11/2007 Hoser ..... F16M 11/28 248/125.8

(Continued)

FOREIGN PATENT DOCUMENTS

DE 202013100609 * 2/2013 ..... B44D 3/123
DE 202013100609 10/2013
FR 2363451 3/1978

OTHER PUBLICATIONS

PCT International Search Report for PCT International Patent Application No. PCT/EP2016/079050; dated Mar. 31, 2017; (3 pages).

(Continued)

*Primary Examiner* — Robert J Hicks
(74) *Attorney, Agent, or Firm* — K&L Gates LLP

(57) ABSTRACT

A mobile and height adjustable bucket system (1) for decorative or protective liquids such as paints and the like made up of a bucket (2) detachably mounted on a height adjustable stand (3) and a toolbox (4) for holding tools which can be attached to the bucket (2), the stand (3) being adjustable as required by a user using a telescopic pole (17) to position the bucket (2) at a desired working height.

10 Claims, 5 Drawing Sheets

(58) Field of Classification Search
CPC ..... B65D 1/12; B65D 25/04; B65D 25/32; B65D 61/00; B65D 25/22; B65D 25/24; A47G 23/02; A47G 1/1653; A01K 97/06
USPC ..... 220/697, 475, 736, 735, 23.4, 630, 628; 248/146, 168, 346.01, 689, 682, 121, 126, 248/127, 200, 317, 518, 227.3, 220.21, 248/224.8, 177.1, 311.2, 310
See application file for complete search history.

(56) References Cited

U.S. PATENT DOCUMENTS

| | | | | |
|---|---|---|---|---|
| 2003/0150964 | A1 | 8/2003 | Sherer et al. | |
| 2008/0149791 | A1* | 6/2008 | Bradley | E04H 12/2253 248/220.21 |
| 2009/0314788 | A1* | 12/2009 | Douglas | A46B 17/02 220/697 |
| 2013/0075547 | A1* | 3/2013 | Cisneros | B44D 3/14 248/129 |
| 2015/0196113 | A1* | 7/2015 | Jacobson | B25H 3/00 206/361 |
| 2017/0045217 | A1* | 2/2017 | Bowden | F21V 33/0084 |
| 2017/0129277 | A1* | 5/2017 | Rogowski | B44D 3/14 |

OTHER PUBLICATIONS

PCT Written Opinion for PCT International Patent Application No. PCT/EP2016/079050; dated Mar. 31, 2017; (4 pages).

* cited by examiner

MOUNTABLE BUCKET SYSTEM

CROSS REFERENCE TO RELATED APPLICATIONS

This is the national phase under 35 U.S.C. § 371 of International Application No. PCT/EP2016/079050, filed on Nov. 28, 2016, which claims priority to and the benefit of GB 1520974.5, filed on Nov. 27, 2015, the entire disclosures of each of which are incorporated by reference herein.

INTRODUCTION

This invention relates to a bucket for liquids and more particularly to a height adjustable bucket system for decorative or protective liquids such as paints.

BACKGROUND

Decorative and protective liquids such as paints can be applied to surfaces directly from paint cans or larger containers in which the paint is purchased. Where the paint is to be applied using a roller, the paint is usually decanted into a roller tray while, where large areas are to be painted with a roller, the paint is typically decanted into larger volume roller paint buckets.

Numerous systems have been previously proposed for holding a container on a stand, or the like, but all these lack the versatility that is required for the modern day painter and decorator when working from heights & ground levels. Such systems are disclosed in U.S. Pat. Nos. 4,398,690; 8,333,394; US2003/0126711; U.S. Pat. No. 5,211,294; WO2013/084239; US2003/0150964 DE202013100609 and FR 2 363 451. When completing such painting tasks the painter is required to use multiple tools and accessories whilst adhering to strict health and safety regulations when undertaking work at heights.

Known containers suffer from a number of disadvantages. For example, for safety reasons, it is generally recommended that, when working at a height on a ladder, a painter should maintain three points of contact with the ladder. However, where a painter is required to hold a conventional paint container in one hand and a paintbrush in the other, it becomes impossible to maintain three points of contact with the ladder giving rise to safety risks. Similarly, it is not possible for a painter to maintain three points of contact when ascending or descending ladders with handheld paint containers or tools. Moreover, due to the safety risks associated with carrying large and heavy volumes of paint up a ladder, painters must make frequent upwards and downwards trips on ladders to replenish or replace the paint containers. Another problem with paint containers is that the container can become unbalanced when lifted especially when an implement is hung off the container which frequently happens in use. This results in spillage of paint from the container.

It is also customary to replenish or fill known paint containers such roller trays or buckets at ground level giving rise to frequent bending by a painter which can result in back strain while the frequent re-filling necessitated by known low-volume containers further increases the risk of physical strain and slows down the painting process.

It is therefore an object to provide a new bucket system to obviate the above disadvantages.

SUMMARY

According to the invention there is provided a bucket system comprising:

a bucket for liquids, and a toolbox attachable to the bucket at a bucket attachment.

Preferably, the bucket attachment comprises a clip-on attachment. More preferably, the clip-on attachment comprises a flap on the toolbox.

Advantageously, the toolbox comprises compartments.

In a preferred embodiment of the invention, the bucket system further comprises a stand having a height adjusting mechanism on which the bucket is mountable.

Preferably, the bucket is reversibly mountable on the stand at a bucket mounting. More preferably, the bucket mounting comprises a mounting bracket on the stand. Most preferably, the mounting bracket comprises a platform for supporting the bucket.

Suitably, the height adjusting mechanism comprises a telescopic pole.

Preferably, the stand comprises a mobile stand. More preferably, the mobile stand comprises casters. Most preferably, the casters are lockable.

Advantageously, the bucket system further comprises a scraper blade to facilitate removal of excess liquid from a brush. Preferably, the scraper blade is provided on the toolbox.

Optionally, the bucket system further comprises a tool holder. Preferably, the tool holder comprises a paint roller holder. More preferably, the paint roller holder comprises a slot in the bucket. In one embodiment there is provided a separate mini roller tray as a clip-on attachment.

Alternatively, the tool holder comprises a magnetised plate on the bucket or a lug for hanging tools. Preferably, the lug is provided on the toolbox.

In a preferred embodiment of the invention, the bucket system is a paint bucket system.

The height adjustable bucket system of the invention ensures that when painting at a height or at ground level, the task is convenient, safe and time efficient. A user can fill the bucket with the desired quantity of paint, load the attachable toolbox with the required tools at ground level and then, using the telescopic pole, elevate the bucket on the stand to the desired height for use thus allowing a painter to keep both hands free while climbing and descending ladders. Accordingly, painting and decorating processes are made safer due to three points of contact being maintained by the painter with the ladder whilst working at a height and whilst retrieving paint and paint tools. Moreover, whilst working at a height, a user can undertake multiple remedial and preparatory tasks without being required to climb down to ground level to retrieve the associated tools which are stored in the toolbox e.g. scraping, filling, cleaning and sanding tools, masking tape and the like. A user can also fill the bucket at height as required thus saving the user from excessive bending and straining. In addition, the paint-filled bucket and toolbox can be easily moved from place to place on the casters of the mobile stand.

The tool holders present on the bucket and the toolbox also serve as useful aids to a user. For example, the magnetised plate can securely hold paint brushes when not in use, the paint roller slot can hold a paint roller over the bucket when not in use, and the lugs on the toolbox can be used for holding filler guns, long tools and the like.

The scraper blade on the toolbox facilitates the removal of excess paint from brushes and ensures that the removed paint drips back into the paint bucket.

In one embodiment there is provided a handle configured to pivot from a closed position to an open position to enable transportation of the bucket in use In one embodiment there is provided a handle restrictor to control the pivoting of the handle.

In one embodiment the bucket side walls are dimensioned with two lips or abutments positioned close to the handle to form said restrictor.

In one embodiment the handle can only pivot substantially ninety degrees from the closed position to the open position.

In one embodiment the underside of the bucket comprises a plurality of female slots for receiving complimentary male equivalent members positioned on the mounting bracket.

In one embodiment the bucket comprises a pull clip positioned on the base of the bucket that is configured to release the male members on the mounting bracket In one embodiment the mounting bracket comprises a cut out slot to enable mounting or demounting of the bucket from the bracket or tripod.

In one embodiment the cut out slot can be dimensioned for receiving a chamfered male push clip which can be attached to the pull clip on the base of the bucket.

In one embodiment there is provide a handle tipping restrictor adapted to balance the bucket when a tool attachment is in place.

In one embodiment there is provided a clip-on tool attachment design adapted for easy fit attachment on and off bucket.

The paint bucket also has a large volume capacity which minimises the number of bucket re-fills required during a painting operation. For example, volume capacity can be 5 litres or more.

The paint bucket of the invention can also be used as a standalone bucket without the stand. It will be appreciated that the paint bucket can be dimensioned to receive a liner device to allow for easy fill and removal of paint from the paint bucket.

The bucket system of the invention is particularly suitable for use by painters, both amateur and professional, for the application of decorative liquids such as paints. However, as will be appreciated by those skilled in the art, the bucket system of the invention can be used with a wide range of decorative or protective liquids such as anti-fungal liquids, pastes and plasters.

It will be appreciated that other tool attachments can be incorporated into the bucket system.

BRIEF DESCRIPTION OF THE DRAWINGS

The invention will now be described, by way of example only, with reference to the accompanying drawings in which.

DETAILED DESCRIPTION OF THE INVENTION

Figure 1:
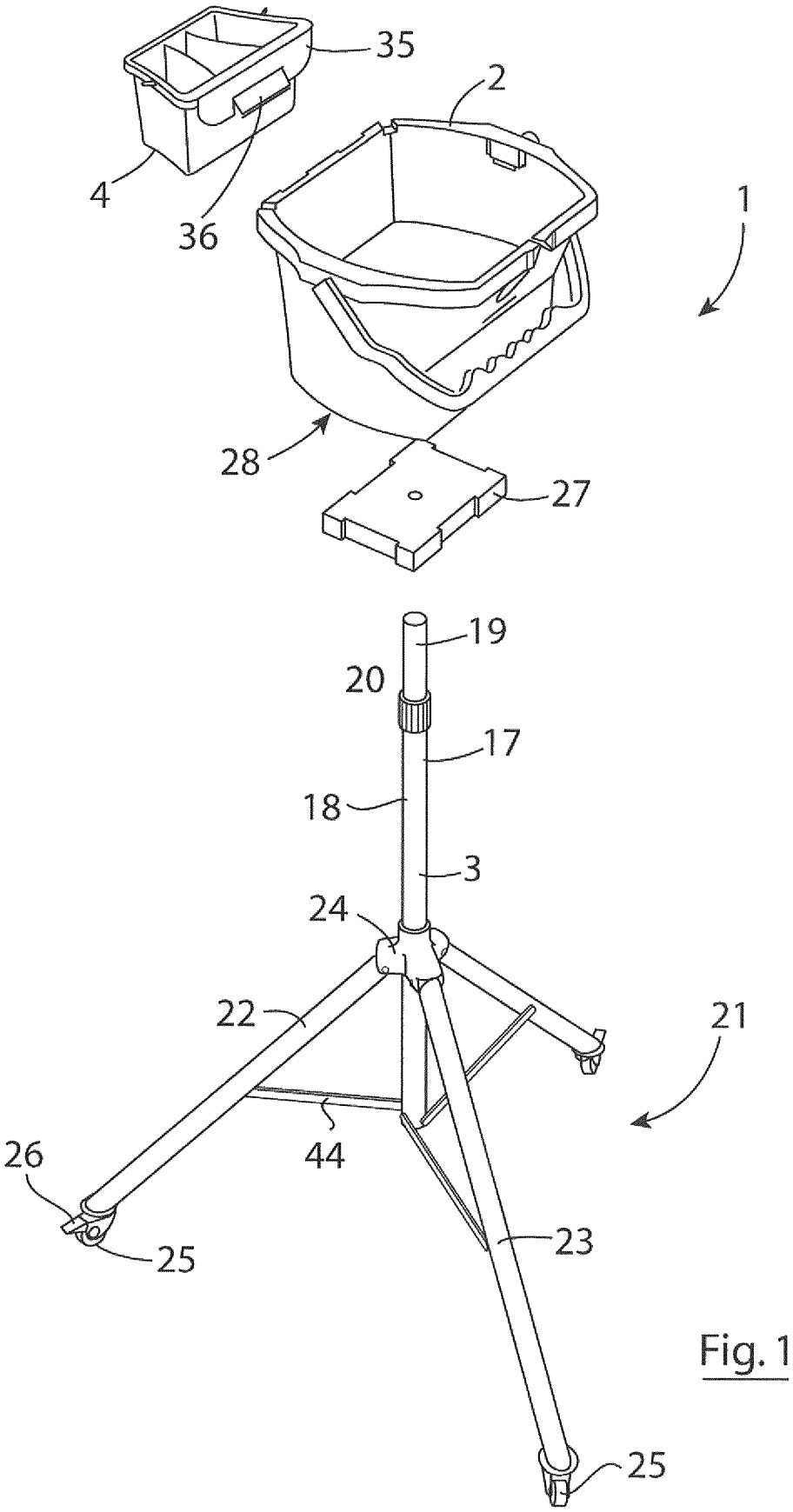
FIG. 1 is an exploded perspective view from above and one side of a mobile height adjustable paint bucket system of the invention with the clip-on toolbox attachment and the telescopically adjustable tripod stand separated from the paint bucket for clarity.
Figure 2:
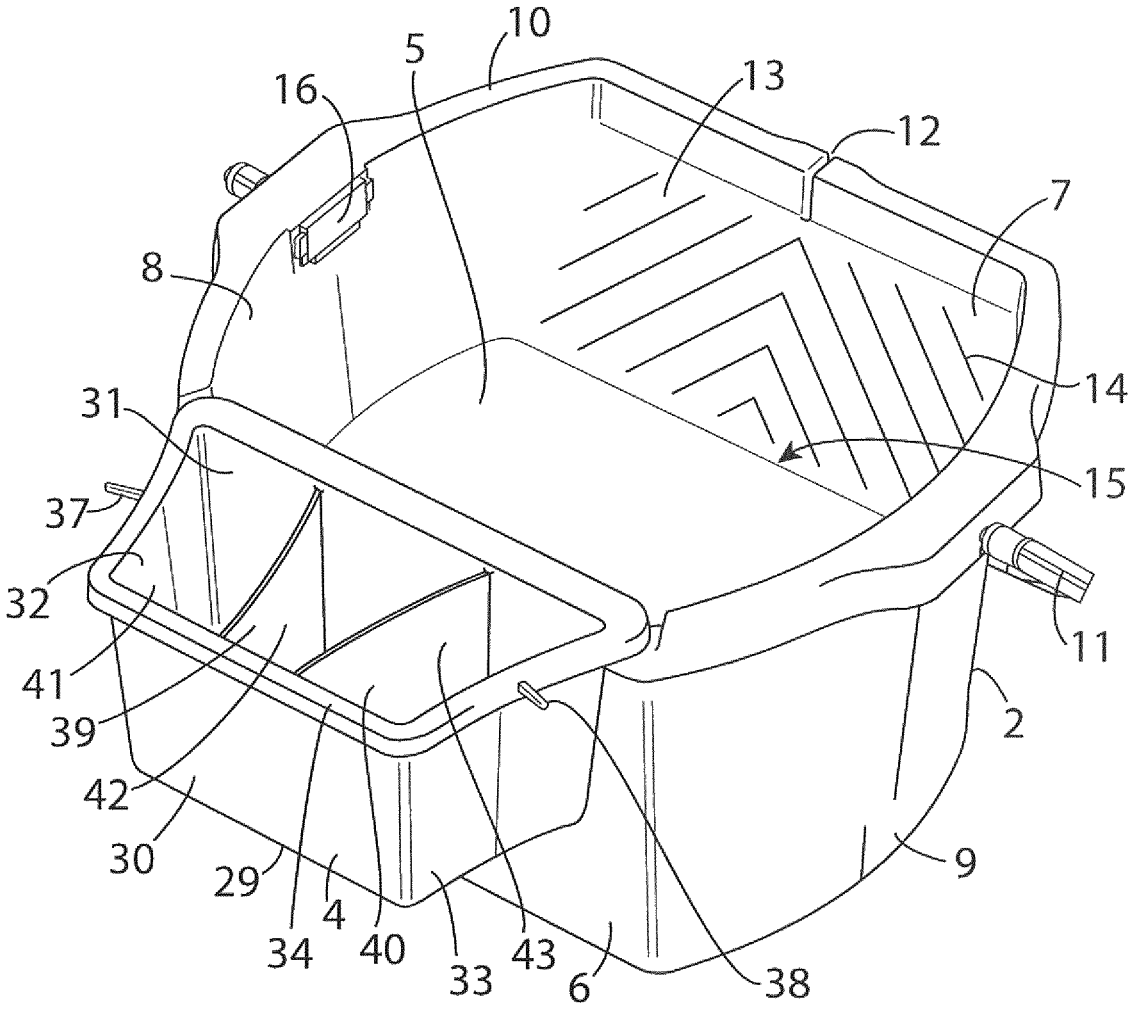
FIG. 2 is an enlarged perspective view from above and one side of the paint bucket of FIG. 1.

As shown in the drawings, a mobile and height adjustable bucket system for decorative or protective liquids such as paints and the like is generally indicated by the reference numeral 1 and is made up of a bucket 2 detachably mounted on a height adjustable stand 3 and a toolbox 4 for holding tools which can be attached to the bucket 2. The stand 3 can be adjusted as required by a user to position the bucket 2 at a desired working height.

The bucket 2 is formed from a bottom wall 4 having a front wall 6, a rear wall 7, a first side wall 8 and a second side wall 9 upstanding therefrom. An upper rim 10 extends along the front wall 6, the rear wall 7 and the first and second side walls 8,9 while a handle 11 extends between the side walls 8,9 at the upper rim 10.

The upper rim 10 is provided with a tool holder in the form of a paint roller slot 12 at the rear wall 7 for holding a paint roller when not in use on the bucket 2. A paint roller can be held in the slot 12 with its roller end disposed within the bucket 2 to contain any paint dripping from the roller.

Internally, the bucket 2 is provided with an inwardly sloped internal face 13 at the rear wall 7. The sloped internal face 13 is provided with outwardly projecting ribs 14 and serves as a rolling surface for a paint roller to ensure even distribution of paint on the roller and to remove excess paint from the roller. The bucket 2 is also provided with volume markers 15 on the sloped internal face 13.

The first side wall 8 is also provided with a tool holder in the form of a magnetised tool plate 16 adjacent the rim 10 for magnetically holding a tool such as a brush in the bucket 2. Like the paint roller slot 12, the magnetised tool or brush plate 16 can hold a brush within the bucket 2 so that excess paint from the brush is contained within the bucket 2.

The stand 3 is made up of an upstanding telescopic pole 17 having and outer tube 18 and an inner extension pole 19 slidably mounted in the outer tube 18 so that the length of the telescopic pole 17 can be adjusted as required. The telescopic pole 17 is provided with a locking ring 20 to set and hold the telescopic pole 17 at the desired height.

The telescopic pole 17 is supported in the upright position by a collapsible base 21 made up of a tripod 22 defined by three tripod legs 23 secured at one end to the outer tube 18 of the telescopic pole 17 at a slidable sleeve 24 which is slidable along the outer tube to open and collapse the tripod 22. The tripod legs 23 are provided with casters 25 at their free ends on which the stand 3, and hence the bucket system 1, is mobile. Each caster 25 is fitted with a caster brake or lock 26 to lock the stand 3 in position and prevent unwanted movement of the bucket system 1.

Each leg 23 of the tripod 22 is further provided with a supporting strut 44 which extends between each leg 23 and the outer tube 18 of the telescopic pole 17.

The bucket 2 is supported on the stand 3 at a bucket mounting made up of a platform-like mounting bracket 27 between the bucket 2 and the stand 3. More particularly, the platform-like mounting bracket 27 is mounted on the free end of the extension pole 19 while the bottom wall 5 of the bucket 2 is shaped, contoured and provided with ribs as indicated by the reference numeral 28 to co-operate with the mounting bracket 27 and receive the mounting bracket 27 in a push-fit relationship to support the bucket 2 on the extension pole 19.

The toolbox 4 is substantially trapezoidal in shape when viewed from above and is made up of a trapezoidal bottom wall 29 having a front wall 30, a rear wall 31 and inwardly curved or concave first and second side walls 32,33 upstanding therefrom. The front wall 30, rear wall 31 and side walls 32,33 terminate at a toolbox rim 34 provided with a bucket attachment in the form of a depending clip-on flap 35 at the rear wall 31 so that the toolbox 4 can be fixed to or mounted on the rim 10 of the bucket 2. More particularly, the toolbox 4 can be simply mounted on the bucket 2 by inserting the rim 10 at the front wall 6 of the bucket 2 between the depending flap 35 and the rear wall 31 of the toolbox 4. A downwardly oriented scraper blade 36 is provided on the flap 35 to facilitate removal of excess liquid from brushes and the like. As the blade 36 is disposed within the bucket 2 when the toolbox 4 is mounted at the front wall 6 of the bucket 2, any excess liquid removed using the blade 36 is directed into the bucket 2.

Externally, the toolbox 4 is provided tool holders in the form of outwardly extending first and second tool lugs 37, 38 on the rim 34 at each side wall 32, 33 respectively. Tools can be hung from the lugs 37, 38 as required.

Internally, the toolbox is provided with first and second spaced apart dividing walls 39,40 to subdivide the toolbox into first, second and third internal storage compartments 41,42,43 respectively in which tools of various types can be stored as required.

In use, a user simply assembles the bucket system 1 by mounting the bucket 2 on the stand 3 as previously described and, if desired, by mounting the toolbox 4 on the bucket 2. The working height of the bucket 2 can be adjusted by, firstly, setting the extension pole 19 at the desired height and, secondly, locking the extension pole 19 at the desired height with the locking ring 20.

The bucket system 1 can be moved to any desired location on the casters 25 which can also be safely locked with the caster locks 26 to prevent undesired movement.

The bucket 2 can be filled with liquids such as paint for easy access at the desired working height while the tool plate 16 and the tool box 4 serve to hold brushes and other tools such as screw drivers and scrapers and other materials such as white spirits, sand paper/blocks, cloths, gloves, masking tape etc. as required in an easily accessible manner without requiring repeated mounting and demounting of a ladder.

Figure 3:
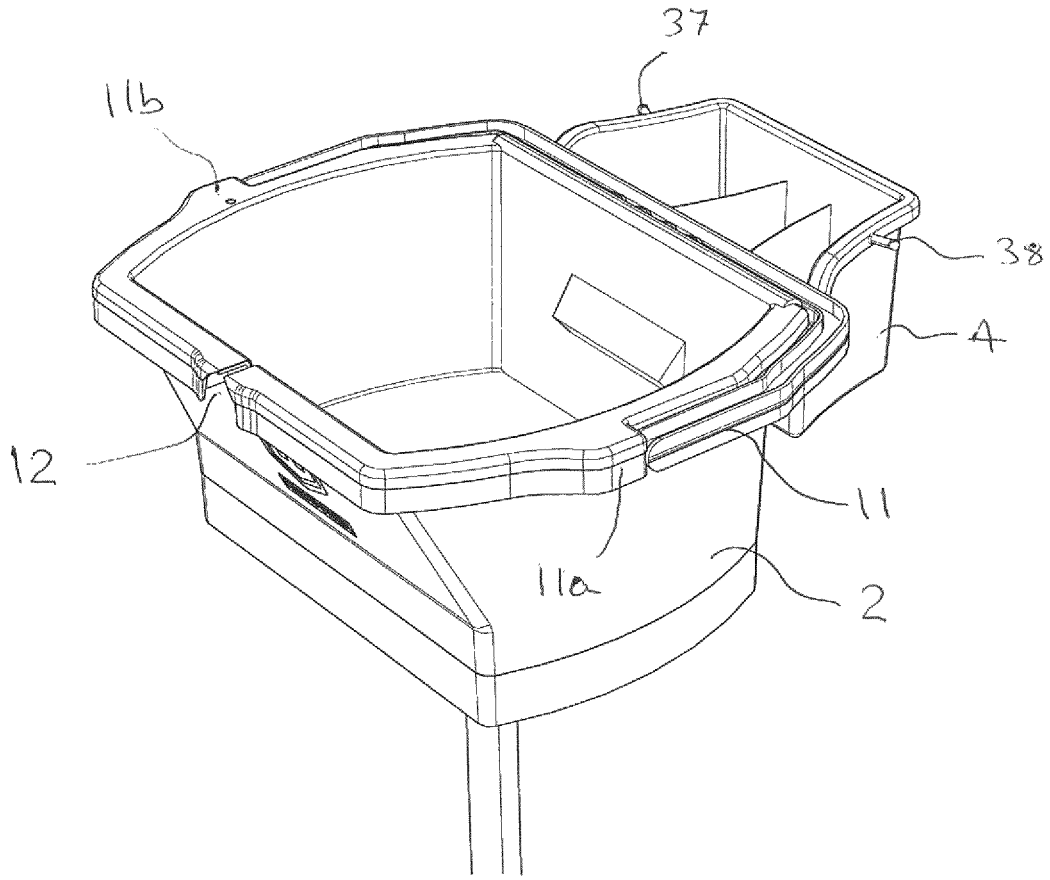
FIG. 3 illustrates an enlarged perspective view of the paint bucket and the clip-on toolbox and a handle tipping restrictor adapted to balance the bucket when a tool attachment is in place.

FIG. 3 illustrates an enlarged perspective view of the paint bucket 2 and the clip-on toolbox comprising a handle tipping restrictor 11*a* and 11*b* adapted to balance the bucket when a tool box 4 attachment is in place. The handle 11 can pivot from a closed position to an open position to enable transportation of the bucket in use. Illustrated in FIG. 3, the handle 11 is in a closed position and the bucket side walls are dimensioned with two lips or abutments 11*a* and 11*b* positioned close to where the handle 11 pivots on the paint bucket 2. The abutments 11*a* and 11*b* are formed to act as handle 11 restrictors which in turn can provide an effective counter balance for the bucket 2 in use. The abutments 11*a* and 11*b* ensure that the bucket 2 does not tilt over or spill paint when the tool attachment is filled with tools and accessories, that would otherwise cause the bucket to tilt over and spill paint.

Figure 4:
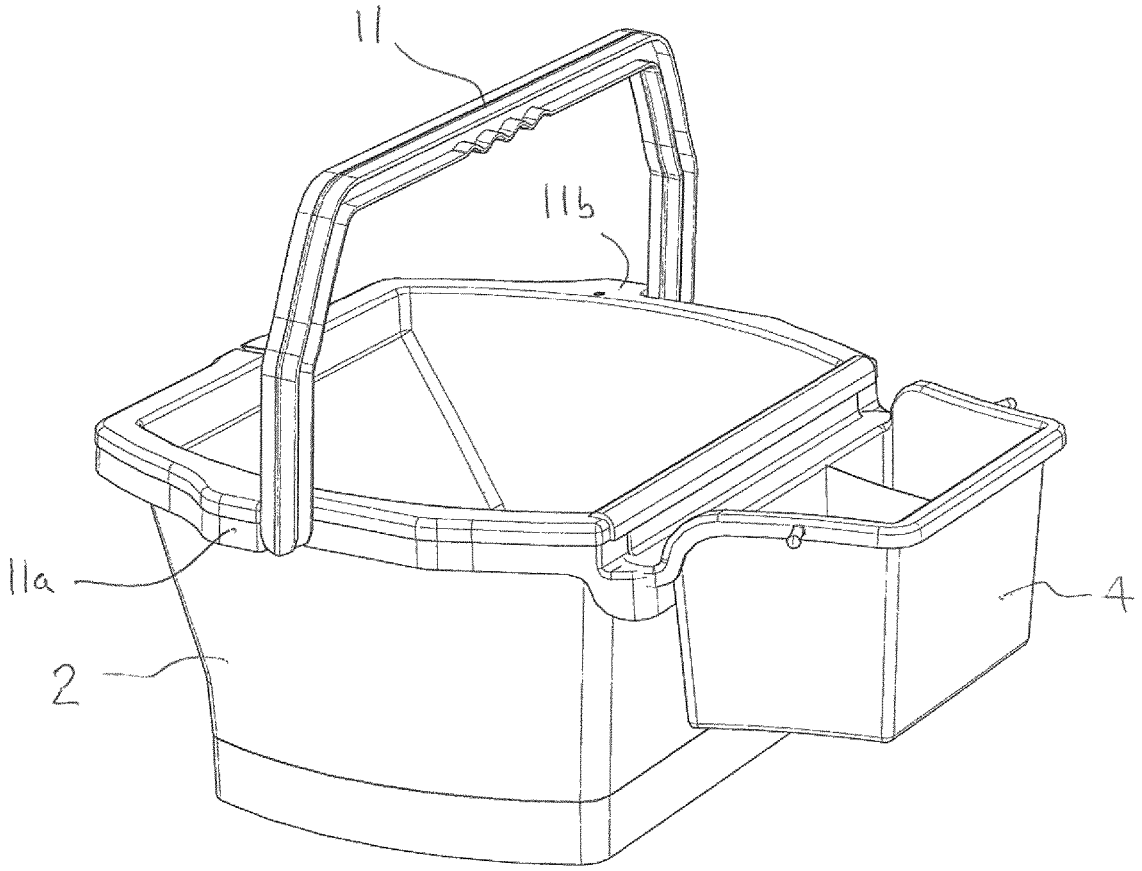
FIG. 4 illustrates operation of the tipping restrictor shown in FIG. 3.

FIG. 4 illustrates operation of the tipping restrictor shown in FIG. 3 showing the handle 11 in the open position. When tools or accessories are stored in the tool box 4 the abutments 11*a* and 11*b* ensures that the bucket 2 does not tilt over to the side when lifted by a user or painter, thereby preventing spillage.

Figure 5:
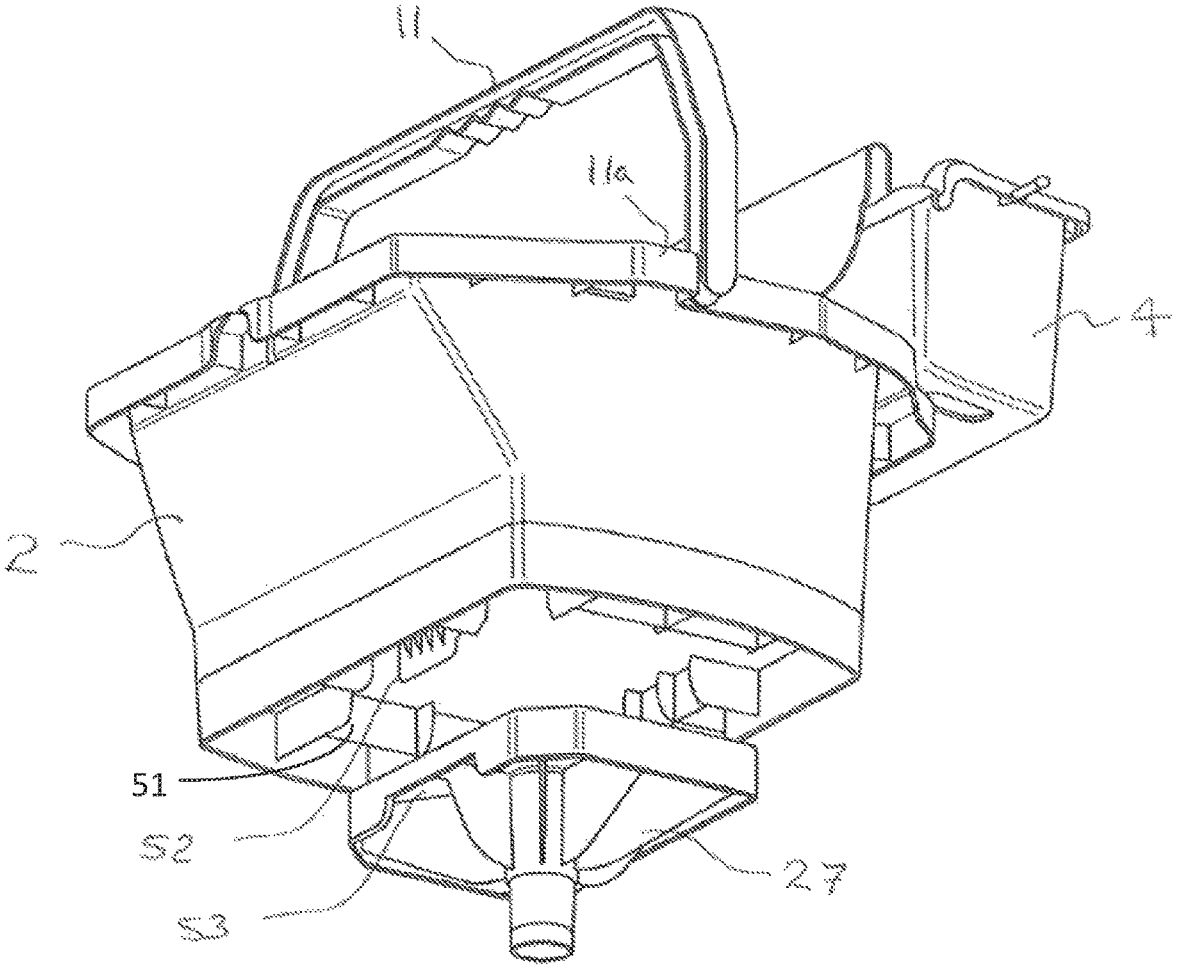
FIG. 5 illustrates an enlarged perspective view from underneath of the paint bucket and tripod attachment.

FIG. 5 illustrates an enlarged perspective view from underneath of the paint bucket 2 and tripod attachment, which can be in the form of a mounting bracket 27 inserted on top or the tripod extension pole or in some embodiments integrally formed with the tripod. On the underside of the bucket 2 there is located a number of chamfered female slots 51 for receiving male equivalent members positioned on the mounting bracket 27 (not shown). The purpose of the slots is that they can easily engage to secure the bucket 2 safely to the adjustable height stand. In addition the bucket comprises a pull clip 52 positioned on the base of the bucket 2 that is configured to release the male members on the mounting bracket 27 to easily detach the bucket from the bracket 27 when required to transport the bucket to another location. In addition it was found that by providing a cut out slot 53 in the mounting bracket 27 enables easier mounting or demounting of the bucket from the bracket or tripod. The cut out slot can be dimensioned for receiving a chamfered male push clip which can be attached to the pull clip 52 on the base of the bucket 2. This enables easy cooperation of the bucket to the mounting bracket 2. The clips can be angled to allow smoother/easier attaching or detaching of the bucket to the mounting bracket. Whilst the bucket 2 is securely attached to the mounting bracket 27 the dimensioned slot makes it easy to securely attach or detach the bucket.

In the specification the terms "comprise, comprises, comprised and comprising" or any variation thereof and the terms include, includes, included and including" or any variation thereof are considered to be totally interchangeable and they should all be afforded the widest possible interpretation and vice versa.

The invention is not limited to the embodiments hereinbefore described but may be varied in both construction and detail.

The invention is not limited to the embodiments herein described which may be varied in construction and detail without departing from the scope of the invention.

The invention claimed is:

1. A bucket system comprising:

a bucket for liquids, a toolbox attachable to the bucket at a bucket attachment;

a stand having a height adjusting mechanism on which the bucket is mountable;

wherein the bucket is reversibly mountable on the stand at a bucket mounting; and wherein the bucket mounting comprises a mounting bracket on the stand;

wherein an underside of the bucket comprises a plurality of female slots for receiving the mounting bracket; and wherein the mounting bracket comprises a cut out slot to enable mounting or demounting of the bucket from a bracket or a tripod.

2. A bucket system as claimed in claim 1 wherein the bucket attachment comprises a clip-on attachment.

3. A bucket system as claimed in claim 1 wherein the bucket attachment comprises a clip-on attachment and wherein the clip-on attachment comprises a flap on the toolbox.

4. A bucket system as claimed in claim 1 wherein the toolbox comprises compartments.

5. A bucket system as claimed in claim 1 comprising a handle configured to pivot from a closed position to an open position to enable transportation of the bucket in use and a handle restrictor to control the pivoting of the handle.

6. A bucket system as claimed in claim 5 wherein the bucket comprises side walls which are dimensioned with two lips or abutments positioned close to the handle to form said handle restrictor.

7. A bucket system as claimed in claim 1 wherein the bucket comprises a pull clip positioned on the base of the bucket that is configured to release the mounting bracket.

8. A bucket system as claimed in claim 1, wherein the cut out slot can be dimensioned for receiving a chamfered male push clip which can be attached to the pull clip on the base of the bucket.

9. A bucket system as claimed in claim 1 further comprising a scraper blade to facilitate removal of excess liquid from a brush, wherein the scraper blade is provided on the toolbox.

10. A bucket system as claimed in claim 1 further comprising a tool holder.

* * * * *